United States Patent [19]

Jeschke

[11] 4,261,262

[45] Apr. 14, 1981

[54] DEVICE FOR CLAMPING A RUBBER BLANKET ON THE BLANKET CYLINDER OF ROTARY PRINTING MACHINES

[75] Inventor: Willi Jeschke, Heidelberg, Fed. Rep. of Germany

[73] Assignee: Heidelberger Druckmaschinen Aktiengesellschaft, Heidelberg, Fed. Rep. of Germany

[21] Appl. No.: 79,183

[22] Filed: Sep. 26, 1979

[30] Foreign Application Priority Data

Sep. 27, 1978 [DE] Fed. Rep. of Germany ..... 2842000

[51] Int. Cl.[3] ..... B41F 7/22; B41F 27/12

[52] U.S. Cl. ..... 101/415.1

[58] Field of Search ..... 101/415.1, 378, 125, 101/126, 131, 131.5, 132, 132.5, 418, 407 A; 51/364, 367, 368; 355/3 DR; 358/291; 346/138

[56] References Cited

U.S. PATENT DOCUMENTS

| | | | |
|---|---|---|---|
| 2,627,230 | 2/1953 | Huck et al. | 101/415.1 |
| 2,727,463 | 12/1955 | Foster, Jr. | 101/415.1 |
| 2,850,970 | 9/1958 | Brodie | 101/415.1 |

FOREIGN PATENT DOCUMENTS

| | | | |
|---|---|---|---|
| 1124051 | 2/1962 | Fed. Rep. of Germany | 101/415.1 |
| 1239706 | 11/1967 | Fed. Rep. of Germany | 101/415.1 |

*Primary Examiner*—J. Reed Fisher

*Attorney, Agent, or Firm*—Herbert L. Lerner; Laurence A. Greenberg

[57] ABSTRACT

Device for clamping a blanket on the blanket cylinder of rotary printing machines having an outer cylindrical surface formed with a slot extending parallel to the axis of the cylinder and widening radially inwardly, the slot accommodating at the radially inwardly widened region thereof two rotatable clamping spindles for clamping the blanket, each of the clamping spindles being formed with a longitudinal groove for receiving respective ends of the blanket therein, the respective ends of the blanket having sheathing thereon, including at least one support rod disposed in the widened region of the slot between the outer cylindrical surface of the cylinder and the two clamping spindles, the support rod extending parallel to and being slightly spaced from the clamping spindles, the support rod, during clamping of the blanket, being in engagement with a part of the blanket adjacent the sheathing and forming an angle in the blanket part so as to force the sheathing fully into the respective longitudinal groove and prevent it from slipping out of the groove.

6 Claims, 6 Drawing Figures

DEVICE FOR CLAMPING A RUBBER BLANKET ON THE BLANKET CYLINDER OF ROTARY PRINTING MACHINES

The invention relates to a device for clamping rubber blankets on the blanket cylinder of rotary printing machines having an outer cylindrical surface formed with a slot extending parallel to the axis of the cylinder and widening inwardly, the slot accommodating two rotatable clamping spindles for clamping the blanket, each of the clamping spindles being formed with a longitudinal groove for receiving respective ends of the blanket therein, the respective ends of the blanket having armor or sheathing thereon.

In a heretoforeknown device of this general type (German Pulblished Prosecuted Application DE-AS 1 124 051), the blanket ends are provided with armor or sheathing projecting beyond the blanket on both sides thereof. After being inserted into the slots of the clamping spindles, the projecting ends of the armor or sheathing are held on both sides by bushings.

It is accordingly an object of the invention to provide a device for clamping a blanket on a blanket cylinder of a rotary printing machine which, while employing relatively simple means, affords uniform or even and reliable clamping of both ends of the blanket as well as simple and rapid changing of the blanket.

With the foregoing and other objects in view, there is provided, in accordance with the invention, a device for clamping a blanket on the blanket cylinder of rotary printing machines having an outer cylindrical surface formed with a slot extending parallel to the axis of the cylinder and widening radially inwardly, the slot accommodating at the radially inwardly widened region thereof two rotatable clamping spindles for clamping the blanket, each of the clamping spindles being formed with a longitudinal groove for receiving respective ends of the blanket therein, the respective ends of the blanket having sheathing thereon, comprising at least one support rod disposed in the widened region of the slot between the outer cylindrical surface of the cylinder and the two clamping spindles, the support rod extending parallel to and being slightly spaced from the clamping spindles, the support rod, during clamping of the blanket, being in engagement with a part of the blanket adjacent the sheathing and forming an angle in the blanket part so as to force the sheathing fully into the respective longitudinal groove and prevent it from slipping out of the groove.

The support rod or rods disposed above the clamping spindles are of relatively simple construction and afford relatively easy and rapid insertion of both ends of the blanket into the slot. The support rod or rods also assure reliable and even or uniform clamping of the blanket because the two ends cannot slip out of the slots formed in the clamping spindles due to the formation of the angle in the blanket, and are guided over the entire length thereof.

In accordance with other alternate features of the invention the support rod, which may be a support spindle, has a circular cross section, for example, or a cross section in the form of a triangle with rounded corners, or also have the shape of an angle with the tip of the angle pointing outwardly and the ends of the legs of the angle being rounded off. Since the two ends of the blanket are braced on the support spindle in clamped condition of the blanket, the support spindle can be provided with a relatively small cross section.

In accordance with a further feature of the invention, the support rod is a support spindle having a circular cross-section with a diameter smaller than that of the clamping spindles, the support spindle being rotatably journaled in bearings mounted in respective bridges disposed at opposite end faces of the cylinder.

The support spindle can thereby turn when the blanket ends are being clamped, and affords a relatively simple and rapid changing of the blanket. It can also have a relatively thin construction because it is braced on both sides thereof by the clamped blanket ends.

In accordance with an added feature of the invention, the clamping spindles are spaced from one another, and the support rod is disposed symmetrically to the clamping spindles and has a diameter greater than the spacing between the clamping spindles.

In accordance with an additional feature of the invention, the support rod is a support spindle having an angular or trianglular cross section over the width of the blanket and being nonrotatably mounted in respective bridges disposed at opposite end faces of the cylinder.

In accordance with yet another feature of the invention, the at least one support rod is in the form of support bolts disposed at both sides of the cylinder in the region of the blanket.

In accordance with a concomitant feature of the invention, the support rod is a support spindle rotatably journaled in bearings mounted in respective bridges disposed at opposite end faces of the cylinder, the clamping spindles being also rotatably journaled in bearings mounted in the bridges, respective worm wheels located at one of the bridges and connected to the clamping spindles for rotating the clamping spindle, the support spindle being of conical shape over the width of the blanket, the smaller-diameter end of the conical support spindle being journaled in one bridge at which the worm wheels are located.

Other features which are considered as characteristic for the invention are set forth in the appended claims.

Although the invention is illustrated and described herein as embodied in a device for clamping a rubber blanket on the blanket cylinder of rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
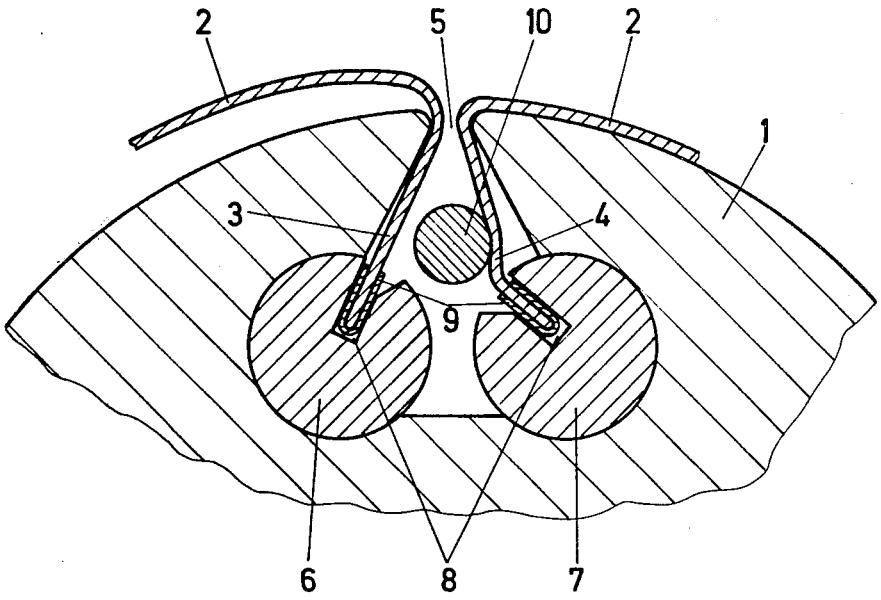
FIG. 1 is a fragmentary cross-sectional view of a cylinder of a rotary printing machine provided with a clamping device wherein ends of a rubber blanket are inserted.

Referring now to the figures of the drawing, there is shown therein a rubber blanket 2 clamped onto a blanket cylinder 1 in a conventional manner, the ends 3 and 4 of the rubber blanket 2 being inserted through a slot 5 formed in the outer cylindrical surface of the blanket cylinder 1. The slot 5 widens out on the radially inward side thereof and accommodates two clamping spindles 6 and 7 therein. Each of the clamping spindles 6 and 7 is formed with a longitudinal groove 8 into which the respective ends of the rubber blanket 2 are inserted. In the illustrated embodiments of FIGS. 1 and 4, the ends 3 and 4 of the rubber blanket 2 are provided with an armor or sheathing 9. By turning the clamping spindles 6 and 7, each of the ends 3 and 4 of the rubber blanket 2 can be clamped separately.

Figure 2:
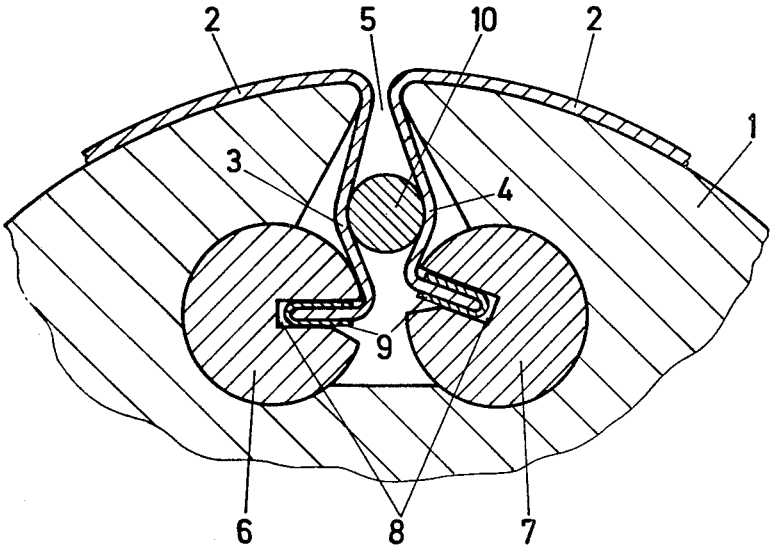
FIG. 2 is another view of FIG. 1 in a different mode of the operation of the clamping device wherein the ends of the rubber blanket are now clamped.

As is evident in the illustrated embodiment of FIGS. 1 and 2, in the widened space between the outer cylindrical surface of the blanket cylinder 1 and the two clamping spindles 6 and 7, a support spindle 10 having a circular cross section is provided extending parallel to and slightly spaced from both clamping spindles 6 and 7, the support spindle 10 being mounted so as to be freely rotatable in bearings 11 on the two end faces of the cylinder 1. The support spindle 10 is disposed symmetrically with respect to the clamping spindles 6 and 7 and has a diameter smaller than the latter yet, nevertheless, greater than the spacing between the two clamping spindles 6 and 7.

In FIG. 1, the end 4 of the rubber blanket 2 is shown already inserted into the longitudinal groove 8 formed in the clamping spindle 7 and the latter is turned slightly in a somewhat counterclockwise direction so that the projecting end 4 is braced or supported at the support spindle 10 and extends at an angle thereto. The armor or sheathing 9 is thereby forced into the longitudinal groove 8 and cannot slip out therefrom. The other end 3 of the rubber blanket 2 is inserted into the respective groove 8 formed in the clamping spindle 6, the latter being in the initial or starting position thereof wherein the rubber blanket end 3 has just been received in the groove 8.

In the mode or phase of operation of the clamping device according to the invention shown in FIG. 2, the rubber blanket 2 is in the clamped condition thereof wherein both of the clamping spindles 6 and 7 have been turned so far with both ends 3 and 4 of the rubber blanket 2 received in the respective longitudinal grooves 8 formed therein, that the rubber blanket 2 is firmly clamped on the outer cylindrical surface of the blanket cylinder 1. The support spindle 10 can turn as the rubber blanket 2 is being clamped, and prevents the ends 3 and 4 of the rubber blanket 2 from slipping out of the grooves 8, so that the ends 3 and 4 are securely clamped along the entire length thereof. Due to the relatively small diameter of the support spindle 10, both ends 3 and 4 of the rubber blanket 2 can be inserted readily into the respective grooves 8. In the clamped condition of the rubber blanket 2, the two ends 3 and 4 of the rubber blanket 2 are disposed on both sides of the support spindle 10 in contact therewith so that the latter cannot bend.

Figure 3:
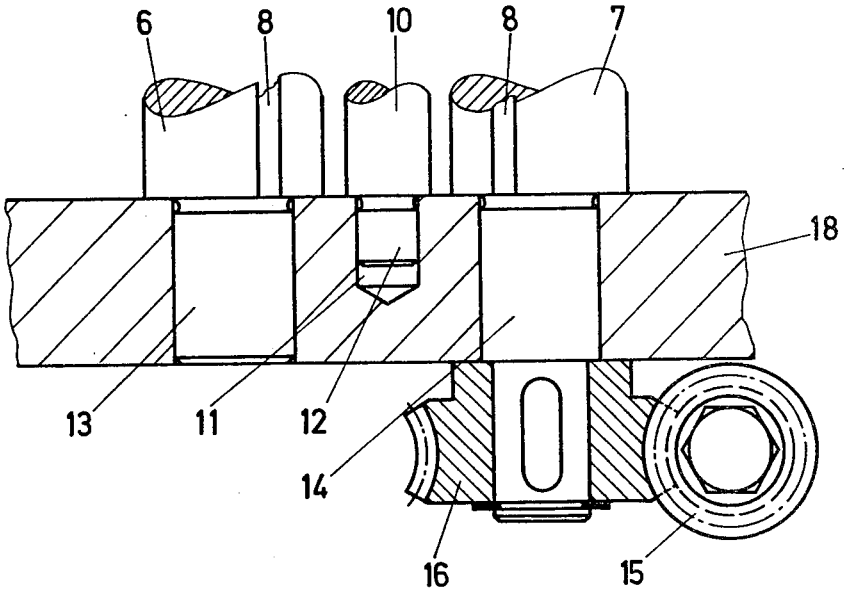
FIG. 3 is a fragmentary axial sectional view of a mounting for the clamping spindles and freely rotatable support spindles shown in FIGS. 1 and 2.

FIG. 3 shows the support spindle 10 rotatably mounted by a journel 12 thereof in one of the bearings 11. The clamping spindles 6 and 7 are also rotatably mounted by journals 13 and 14 thereof in a bridge 18 fastened to the cylinder 1. The clamping spindle 7 is turnable by means of a worm 15 and a worm wheel or gear 16. In the case of the clamping spindle 6, the worm and the worm wheel are located at the opposite side of the cylinder 1 and are, accordingly, not illustrated in FIG. 3; however, note FIG. 5.

Figure 4:
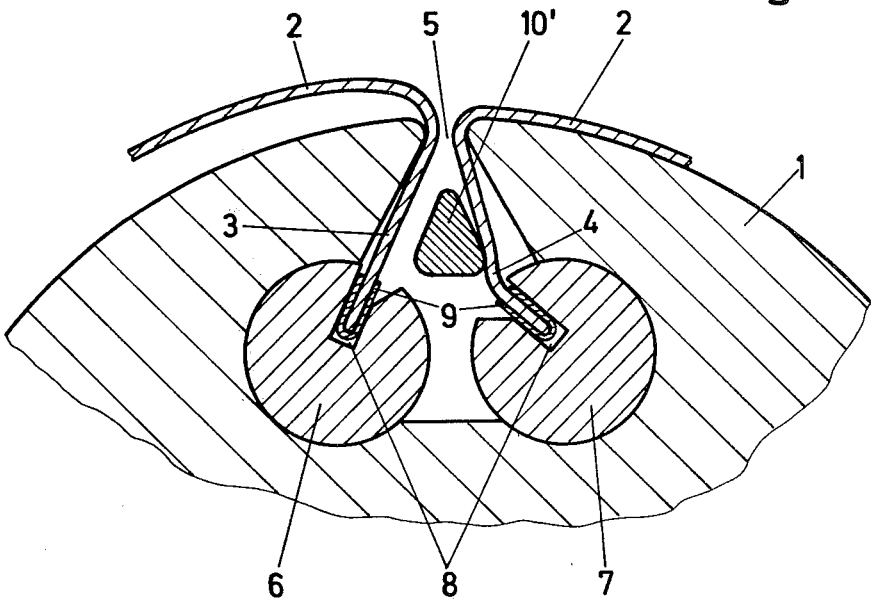
FIG. 4 is a view smilar to that of FIG. 1 of another embodiment of the invention having a support spindle which is of substantially triangular cross section.

The embodiment of the invention shown in FIG. 4 differs from that of FIGS. 1 and 2 in that a support spindle 10′ of substantially triangular cross section has replaced the support spindle 10 of circular cross section. The support spindle 10′ is not rotatably mounted in the bridges 18 and likewise affords a uniform and reliable clamping as well as a readily simple exhanging of the rubber blanket 2.

Figure 5:
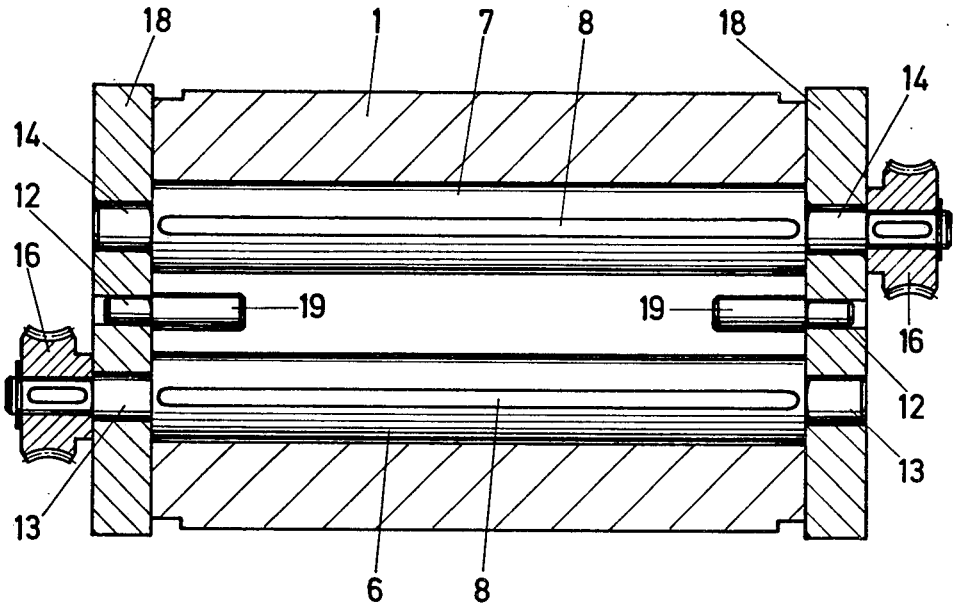
FIGS. 5 and 6 are reduced longitudinal sectional views of the cylinder of FIG. 1 showing two different embodiments of the clamping device.

In the longitudinal sectional view of the cylinder 1 and the clamping device in FIG. 5, support bolts or pins 19, instead of a support spindle 10, are disposed on the inside of the bridges 18 in the region of the rubber blanket 2 and are either rotatably or rigidly mounted in the bridges 18. A result thereof, especially in the case of relatively narrow or small machines, is a reliable and uniform or even clamping of the rubber blanket 2.

Figure 6:
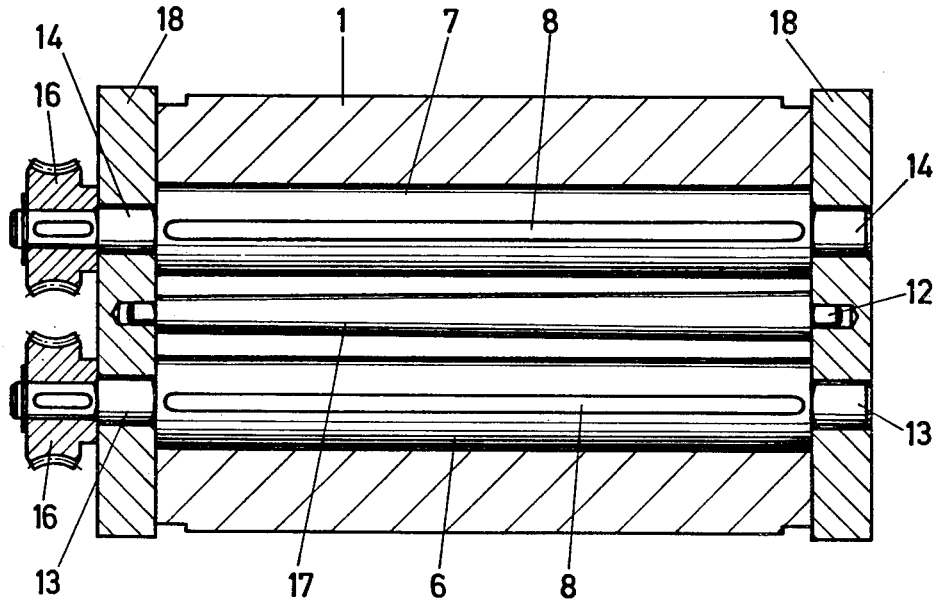

In the embodiment of FIG. 6, the support spindle 17 is of conical construction, the end of smaller diameter thereof being on the side of the worm wheels 16, both of which are on the same side of the cylinder 1 in this embodiment. Especially in the case of relatively wide machines, a conical support spindle can equalize or compensate for torsional stress in the clamping spindles 6 and 7, so that uniform or even clamping is attained over the entire width of the rubber blanket 2.

There are claimed:

1. Device for clamping a blanket on the blanket cylinder of rotary printing machines having an outer cylindrical surface formed with a slot extending parallel to the axis of the cylinder and widening radially inwardly, the slot accommodating at the radially inwardly widened region thereof two rotatable clamping spindles for clamping the blanket, each of the clamping spindles being formed with a longitudinal groove for receiving respective ends of the blanket therein, the respective ends of the blanket having sheathing thereon, comprising at least one support rod disposed in the widened region of the slot between the outer cylindrical surface of the cylinder and the two clamping spindles, said support rod extending parallel to and being slightly spaced from the clamping spindles, said support rod, during clamping of the blanket, being in engagement with a part of the blanket adjacent the sheathing and forming an angle in the blanket part so as to force the sheathing fully into the respective longitudinal groove and prevent it from slipping out of the groove.

2. Device according to claim 1 wherein said support rod is a support spindle having a circular cross-section with a diameter smaller than that of the clamping spindles, said support spindle being rotatably journaled in bearings mounted in respective bridges disposed at opposite end faces of the cylinder.

3. Device according to claim 1 or 2 wherein the clamping spindles are spaced from one another, and said support rod is disposed symmetrically to the clamping spindles and has a diameter greater than the spacing between the clamping spindles.

4. Device according to claim 1 wherein said support rod is a support spindle having an angular cross section over the width of the blanket and being nonrotatably mounted in respective bridges disposed at opposite end faces of the cylinder.

5. Device according to claim 1 wherein said at least one support rod is in the form of support bolts disposed at both sides of the cylinder in the region of the blanket.

6. Device according to claim 1 wherein said support rod is a support spindle rotatably journaled in bearings mounted in respective bridges disposed at opposite end faces of the cylinder, the clamping spindles being also rotatably journaled in bearings mounted in said bridges, respective worm wheels located at one of said bridges and connected to the clamping spindles for rotating the clamping spindles, the support spindle being of conical shape over the width of the blanket, the smaller-diameter end of said conical support spindle being journaled in said one bridge at which said worm wheels are located.

* * * * *